United States Patent [19]

Ames

[11] Patent Number: 4,475,583

[45] Date of Patent: Oct. 9, 1984

[54] STRIP CASTING NOZZLE

[75] Inventor: S. Leslie Ames, Sarver, Pa.

[73] Assignee: Allegheny Ludlum Steel Corporation, Pittsburgh, Pa.

[21] Appl. No.: 545,115

[22] Filed: Oct. 25, 1983

Related U.S. Application Data

[63] Continuation of Ser. No. 148,441, May 9, 1980, abandoned.

[51] Int. Cl.[3] ..... B22D 11/06; B22D 11/10

[52] U.S. Cl. ..... 164/423; 164/429; 164/437

[58] Field of Search ..... 164/423, 427, 429, 437, 164/138, 335, 418, 463

[56] References Cited

U.S. PATENT DOCUMENTS

| | | | |
|---|---|---|---|
| 905,758 | 12/1908 | Strange et al. | 164/427 |
| 993,904 | 5/1911 | Strange | 164/427 |
| 2,878,537 | 3/1959 | Brennan | 164/423 X |
| 3,490,516 | 1/1970 | Basche et al. | 164/423 |
| 3,522,836 | 8/1970 | King | 164/87 |
| 3,605,863 | 9/1971 | King | 164/4 X |
| 3,838,185 | 9/1974 | Maringer et al. | 164/87 X |
| 3,896,203 | 7/1975 | Maringer et al. | 164/87 X |
| 3,976,117 | 8/1976 | Olsson | 164/87 X |
| 4,077,462 | 3/1978 | Bedell et al. | 167/87 |
| 4,142,571 | 3/1979 | Narasimhan | 164/87 X |
| 4,290,476 | 9/1981 | Smith et al. | 164/463 X |

*Primary Examiner*—Nicholas P. Godici
*Assistant Examiner*—J. Reed Batten, Jr.
*Attorney, Agent, or Firm*—Patrick J. Viccaro

[57] ABSTRACT

An apparatus for continuously casting metallic strip material includes a tundish, and a nozzle comprising a slotted element, with the slot having substantially uniform cross-sectional dimensions throughout the longitudinal extent thereof. Disposed outside the nozzle is a cooled casting surface movable past the nozzle in a direction substantially perpendicular to the longitudinal axis of the slot. The slot is defined between first and second lips of the nozzle which have inside surfaces facing one another at least at an inner portion of the slot. The facing inside surfaces diverge from one another at an outer portion of the slot. The first and second lips are further provided with bottom surfaces facing the casting surface at a standoff distance less than 0.120 inch.

11 Claims, 5 Drawing Figures

STRIP CASTING NOZZLE

This is a continuation of application Ser. No. 148,441, filed May 9, 1980, now abandoned.

BRIEF SUMMARY OF THE INVENTION

Incorporated herein, by reference, is the subject matter of co-filed U.S. patent applications entitled "Strip Casting Apparatus", Ser. No. 148,421, now abandoned; "Method and Apparatus for Strip Casting", Ser. No. 148,359; "Method of Repetitiously Marking Continuously Cast Metallic Strip Material", Ser. No. 148,448; and "Apparatus for Strip Casting", Ser. No. 148,440, now abandoned, all of which were filed May 9, 1980 and are assigned to a common Assignee.

The present invention relates to the casting of strip material at high quench rates and at high production rates. More particularly, the present invention is directed to an apparatus for rapidly casting thin metallic strip material characterized by an outwardly diverging nozzle design.

The apparent advantages and economic significance of producing thin metallic strip material by a casting process, as compared to the conventional rolling or reducing operations, are numerous. The fact that strip casting may be performed at such high quench rates to produce amorphous material is even more meaningful. However, it is equally apparent that there are a multitude of strip casting parameters which must be controlled or monitored to assure that the cast strip is of acceptable quality and of uniform composition and structure. For these reasons, those skilled in the art appreciate the intricacy involved in the development of a commercially successful strip casting apparatus.

The general concept of casting thin metallic materials such as sheet, foil, strip and ribbon was disclosed in the early 1900's. For example, U.S. Pat. Nos. 905,758 and 993,904 teach processes wherein molten material flows onto a moving cool surface and the material is drawn and hardened thereon into a continuous thin strip. These references teach that molten metal may be poured onto the smooth peripheral surface of a rotating liquid-cooled copper drum or disc to form strip materials. Despite early disclosure of such concept, there is no evidence of commercial success of strip casting during the early part of the 20th century.

Recently, in U.S. Pat. Nos. 3,522,836 and 3,605,863 a method for manufacturing a continuous product, such as metallic wire or strip from molten metal has been disclosed. These references teach that a convex meniscus of molten material should project from a nozzle. A heat extracting surface, such as a water-cooled drum, is moved in a path substantially parallel to the outlet orifice and into contact with the meniscus of molten metal to continuously draw material from the meniscus to form a uniform continuous product. The above-described method is commonly called the "melt drag" process as the heat extracting surface moving past the meniscus of molten metal at the nozzle orifice actually has an effect on the rate of molten metal flow, or drag, through the nozzle.

More recent strip casting developments focus on relatively narrow refinements in the metallic strip casting art. For example, U.S. Pat. No. 4,142,571 is particularly directed to a slot construction in a metal strip casting nozzle having stringent dimensional requirements. Also, U.S. Pat. No. 4,077,462 pertains to the provision of a specific construction for a stationary housing above the peripheral surface of a chill roll used for strip casting.

There are a number of other rapid quenching techniques known in the art. For example, melt spinning processes of producing metallic filament by cooling a fine molten stream either in free flight or against a chill block have been practiced. Also known are melt extraction techniques, such as crucible melt extraction disclosed in U.S. Pat. No. 3,838,185 and pendant drop melt extraction techniques taught in U.S. Pat. No. 3,896,203. It has been found difficult to produce uniform sheet or strip by such alternative techniques of rapid casting. There are many factors, such as casting temperature and pressure, auxiliary surface cooling rates, surface coatings for the casting surface, and the like which appear to affect the product thickness and the quality of rapidly cast strip material.

Despite the relatively long history of the art of strip casting, and the recent developments in this area, strip casting is not a widely accepted and commercially significant operation at the present time. It appears that various improvements, modifications and innovations are required in the art to effectuate a significant commerical impact in the art of strip casting. In particular, proper relationships among such variables as molten metal tundish construction, nozzle orifice size and dimensions, spacing from a casting surface, speed at which such surface is moved, quench rates, metal temperature and feed rates, and the like may require more accurate identification and interrelation in order to accomplish the uniformity and consistency required for successful, commercial production of cast strip. In particular, certain nozzle and slot structures and their dimensional relationship to the casting surface onto which strip material is cast, have been found to be inadequate to yield uniform strip casting results when utilized in various casting parameters.

Accordingly, a new and improved apparatus for casting relatively wide, thin strip material is desired which overcomes the disadvantages of the prior art structures. Such desired apparatus should be reliable, more efficient and more effective than the structures disclosed in the prior art, and should lead to reproducibility, uniformity and consistency in strip casting.

The present invention may be summarized as providing a new and improved apparatus for continuously casting metallic strip material. Such apparatus comprises a tundish and a nozzle comprising a slotted element, with the slot having substantially uniform cross-sectional dimensions throughout the longitudinal extent thereof. Disposed outside the nozzle is a cooled casting surface movable past the nozzle in a direction substantially perpendicular to the longitudinal axis of the slot. The slot is defined between first and second lips of the nozzle which have inside surfaces facing one another at least at an inner portion of the slot. The facing inside surfaces diverge from one another at an outer portion of the slot. The first and second lips are further provided with bottom surfaces facing the casting surface at a standoff distance less than 0.120 inch.

Among the advantages of the present invention is the provision of a strip casting apparatus which is capable of continuously casting metallic strip material of substantially uniform dimension and substantially uniform quality throughout its length.

Another advantage of the present invention is the provision of a strip casting apparatus having an outwardly diverging nozzle construction which promotes the efficient rapid casting of metal strip material.

An objective of the present invention is to provide a strip casting apparatus capable of reproducing successful strip casting operations.

Another objective of this invention is to provide a strip casting apparatus which can effectuate sufficiently rapid quenching of the produced strip to result in the production of amorphous strip. However, it should be understood that the production of continuously cast crystalline material is also comprehended by the present invention.

A further objective of this invention is to identify certain design and dimensional requirements, particularly with regard to an outwardly diverging nozzle structure, which permit continuous and repetitious rapid casting of metallic strip mateial of uniform dimension and uniform quality.

These and other objectives and advantages will be more fully understood and appreciated with reference to the following detailed description and the accompanying drawings.

DETAILED DESCRIPTION

Figure 1:
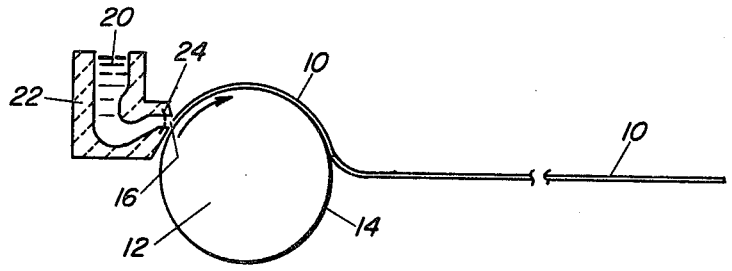
FIG. 1 is an elevation view, partially in cross-section, illustrating a typical apparatus used for continuously casting strip material.

Referring particularly to the drawings, FIG. 1 generally illustrates an apparatus for casting metallic strip material 10 in accordance with the present invention. This apparatus includes an element 12 upon which the strip 10 is cast. In a preferred embodiment a continuous strip 10 is cast onto a smooth, outer peripheral surface 14 of a circular drum or wheel as shown in FIG. 1. It should be understood that configurations other than circular may be employed. For example, a wheel with a smooth, frustoconical outer peripheral surface (not shown) may be employed. Also, a belt capable of rotating through a generally ovular path may also be employed as the casting element. Regardless of the configuration employed, the cooled casting surface should be at least as wide as the strip to be cast.

In a preferred embodiment, the casting element 12 comprises a water cooled, precipitation hardened copper alloy wheel containing about 98% copper and about 2% chromium. Copper and copper alloys are chosen for their high thermal conductivity and wear resistance, however, beryllium copper alloys, steel, brass, aluminum, aluminum alloys or other materials may be utilized alone, or in combination. For example, multipiece wheels having sleeves of molybdenum or other material may be employed. Likewise, cooling may be accomplished with the use of a medium other than water. Water is typically chosen for its low cost and its ready availability.

In the operation of the strip casting apparatus of the present invention, the surface 14 of the casting wheel 12 must be able to absorb the heat generated by contact with molten metal at the initial casting location 16, and such heat must be conducted substantially into the copper wheel during each rotation of the wheel. The initial casting point 16 refers to the approximate location on the casting surface 14 where molten metal 20 from the tundish 22 first contacts the casting surface 14. Cooling, by heat conduction, may be accomplished by delivering a sufficient quantity of water through internal passageways located near the periphery of the casting wheel 12. Alternatively, the cooling medium may be delivered directly to the underside of the casting surface. Understandably, refrigeration techniques and the like may be employed to accelerate or decelerate cooling rates, and/or to effectuate wheel expansion or contraction during strip casting.

Whether a drum, wheel or belt is employed for casting, the casting surface should be generally smooth and symmetrical to maximize uniformity in strip casting. For example, in certain strip casting operations the distance between the outer peripheral casting surface 14 and the surfaces defining the orifice of the nozzle which is feeding the molten material onto the casting surface 14 must not deviate from a desired or set distance during the casting operation. This distance shall hereinafter be called standoff distance or gap. It is understandable that the gap should be substantially maintained throughout the casting operation when it is the intention to cast uniform strip material.

It should be understood that if the casting element is a drum or a wheel, the element should be carefully constructed so as not to be out-of-round during operation to insure uniformity in strip casting. Along these lines, it has been found that a drum or wheel which is out-of-round by about 0.020 inch, or more, may have a magnitude of dimensional instability which unless corrected or compensated during operation, may be unacceptable for certain strip casting operations. It has been found that acceptable dimensional symmetry, as well as the elimination of problems associated with weld porosity may be more readily accomplished by fabricating a wheel or drum from a single, integral slab of cold rolled or forged copper alloy. However, as mentioned above alternative materials, including sleeves and coatings may be employed.

The molten material 20 to be cast in the apparatus described herein is preferably retained in a crucible 22, or tundish, which is provided with a pouring orifice 24 or nozzle. The nozzle is typically, though not necessarily, located at a lower portion of the tundish 22 as shown in FIG. 1. As will be appreciated from the foregoing discussion, the nozzle 24 may be a separate element in the tundish 22, or, the nozzle 24 and tundish 22 may be monolithic, i.e. integrally formed, with all or any portion of the tundish 22.

Figure 2:
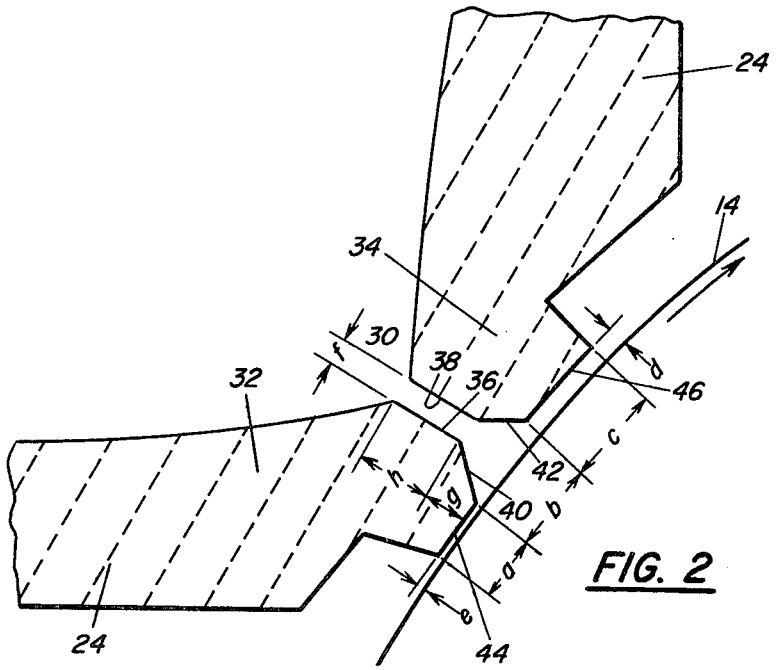
FIG. 2 is a cross-sectional view of an outwardly diverging nozzle in a strip casting apparatus of the present invention.

The nozzle 24, located in or forming a lower portion of the tundish 22 may comprise a slotted element, as best shown in FIG. 2. The slot 30 is preferably substantially centrally located in the nozzle element 24. Such approximate control location of the slot 30 helps to assure uniformity as the pressure of the molten metal bearing thereagainst is substantially equalized during the casting operation. It should be understood, however, that the slot 30 may be located in off-center positions as may be desired.

The longitudinal extent of the slot 30 should approximate the width of the strip to be cast. There does not appear to be a limitation on the longitudinal extent of the slot, and, slots as long as thirty six inches, or longer, are comprehended by the present invention. It is highly desired that the molten metal flow uniformly through the slot 30 in the nozzle 24 of the present invention in order to produce uniform, high quality strip material. In an alternative embodiment, strip of various width may be simultaneous produced by cutting multiple longitudinally aligned slots 30 of appropriate longitudinal extent in the nozzle area of a tundish 22, as opposed to a single slot 30. Regardless of the size of the slot 30, or slots, the cross-sectional dimensions of each slot 30 should be substantially uniform throughout the longitudinal extent thereof to produce strip material having uniform dimensions. In the operation of the strip casting apparatus of the present invention, the cooled casting surface 14 moves past the slot 30 in a direction substantially perpendicular to the longitudinal axis of the slot.

As shown in FIG. 2, the slot 30 is defined between a first lip 32 and a second lip 34 of the nozzle 24. The first lip 32 is located at the downstream edge of the slot 30, with respect to the direction of movement of the casting surface 14 indicated by the arrow in FIG. 2. The second lip 34 is located at an upstream edge of the slot with respect to the casting direction.

Figure 3:
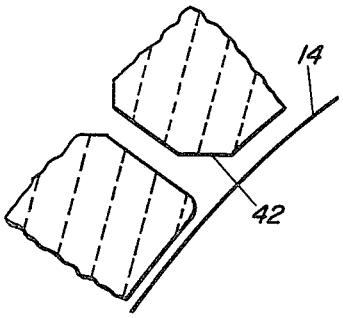
FIGS. 3, 4 and 5 are cross-sectional views of alternative outwardly diverging nozzles in strip casting apparatus of the present invention.
Figure 5:
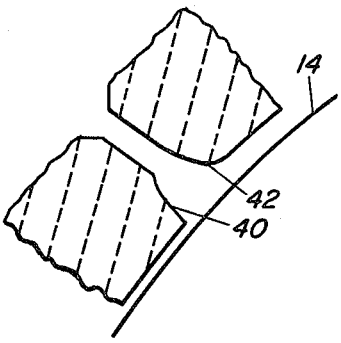

The first lip 32 and the second lip 34 have inside surfaces 36 and 38, respectively, which are substantially parallel to and facing one another at least at an inner portion of the slot 30. The inner portion refers to that portion which is near the molten metal holding portion of the tundish, while an outer portion of the slot 30 refers to that portion near the casting surface 14. It should be understood that the innermost portion of the slot may be relieved or tapered. For example, the innermost portion of the first lip 32 and/or the second lip 34 may be cut into a general V-shape, or a more rounded U-shape creating an initial funnel type structure for the slot as illustrated in FIGS. 3 and 5. Such relief of the innermost portion of the slot 30 may assist in maintaining uniform molten metal flow patterns and minimizing irregularities or turbulence during strip casting. What is required by the present invention is that the inside surfaces 36 and 38 are facing and parallel at least at some inner portion of the slot 30.

Figure 4:
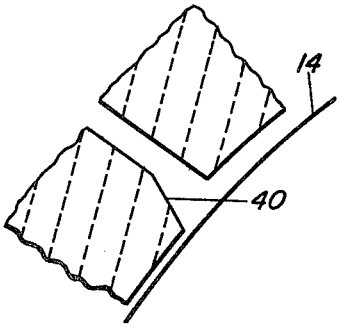

Beyond such inner, parallel, facing portion, in the direction of the casting surface 14, the inside surfaces diverge outwardly from one another at an outer portion of the slot 30. Preferred outwardly diverging surfaces are indicated by reference numerals 40 and 42 in FIG. 2. Such outward divergence of the inside surfaces may be accomplished by alternative structures such as those shown in FIGS. 3, 4 and 5. It should be noted that only one of the inside surfaces need to diverge to create the necessary relationship of outward divergence therebetween as shown in FIGS. 3 and 4. Also, curved surfaces, radiused either inwardly 40 or outwardly 42 as shown in FIG. 5, may establish such outward divergence.

From that outwardly diverging surfaces 40 and 42 the first and second lips 32 and 34 extend to bottom surfaces 44 and 46 respectively. Such bottom surfaces 44 and 46 of the lips 32 and 34 face the casting surface 14, and are located at a standoff distance, or gap, of less than about 0.120 inch from the casting surface. In a preferred embodiment, the standoff distance e between the bottom surface 44 of the first lip 32 and the casting surface 14 is as small as possible consistent with permitting the casting surface 14 to move thereunder in an unobstructed path. In any event, the gap e between the bottom surface 44 of the first lip 32 and the casting surface 14 must be small enough at the nozzle orifice to prevent significant molten metal backflow therebetween during casting. The gap d between the casting surface 14 and the bottom surface 46 of the second lip 34 is preferably less than 0.080 inch, and for casting certain alloys into thin gage strip may be less than 0.010 inch.

Preferably, at least a portion of the bottom surfaces 44 and 46 are in substantially complete parallelism with the casting surface 14 movable therebelow, at least at the nozzle orifice. When utilizing a drum or wheel, and a refractory nozzle 24, such parallelism may be accomplished by placing a sheet of sandpaper, or the like, against the casting surface 14 with the grit side of the sandpaper facing the nozzle 24. By moving the nozzle 24 into tight contact with the casting surface 14, with the sandpaper disposed therebetween, and by moving the casting surface 14 and sandpaper simultaneously past the nozzle 24, the bottom surfaces 44 and 46 are ground by the grit into substantially complete parallelism with the casting surface 14. Such parallelism may be achieved even when round or other curvilinear casting surfaces are employed. To achieve such parallelism on most refractory nozzles by this procedure, 400 or 600 grit sandpaper has been found to be adequate.

It has also been found that the corners between the surfaces defining the slot 30 may be radiused to minimize molten metal turbulence during casting. In certain instances sharp corners may be subjected to various pressure and flow patterns which could create stress conditions for nozzles 24 made of certain materials, and in some instances, may break, crack or wear during casting in a manner which may upset balanced strip casting conditions. Providing such rounded corners may minimize the adverse affects of such turbulence and flow through the nozzle 24.

The crucible 22 is preferably constructed of a material having superior insulating ability. If the insulating ability is not sufficient to retain the molten material at a relatively constant temperature, auxiliary heaters such as induction coils may have to be provided in and/or around the crucible 22, or resistance elements such as wires may be provided. A convenient material for the crucible is an insulating board made from fiberized kaolin, a naturally occurring, high purity, alumina-silica fire clay. Such insulating material is available under the trade name Kaowool HS board. However, for sustained operations, and for casting certain high melting temperature alloys, various other materials may have to be employed for constructing the crucible or the nozzle including graphite, alumina graphite, quartz, clay graphite, boron nitride, silicon nitride, silicon carbide, boron carbide, alumina, zirconia and various combinations or mixtures of such materials. It should be understood that these materials may be strengthened; for example, fiberized kaolin may be strengthened by impregnating with a silica gel or the like.

It is imperative that the orifice of the nozzle 24 remain open and its configuration remain substantially stable throughout at least one, and preferably many strip casting operations. It is understandable that the orifice should not erode or clog, significantly, during strip casting. Along these lines, it appears that certain insulating materials may not be able to maintain their dimensional stability over long casting periods. To obviate this problem, lips 32 and 34 forming the orifice of the nozzle 24 may be constructed of a material which is better able to maintain dimensional stability and integrity during exposure to high molten metal temperatures for prolonged time periods. Such materials may take the form of a single, generally semi-circular element with a slot 30 cut therethrough or a pair of inserts held in the crucible to form a slot 30 therebetween. In a preferred embodiment the slot or slots in single elements may be cut ultrasonically to insure that the desired slot dimensions are accurately provided. Such nozzles 24 may be constructed of materials such as fiberized kaolin, silicon nitride, quartz, graphite, clay graphite, boron nitride, alumina graphite, silicon carbide, stabilized zirconia silicate, zirconia, magnesia, alumina or other similar molten metal resistant material and combinations thereof. Such nozzles 24 may be held in the orifice of the crucible mechanically, with pressure, and/or with the aid of adhesives such as various refractory cements, spring biased mechanisms, or the like.

The drive system and housing for the drum, wheel or other casting surface 14 of the present invention should be rigidly constructed to permit drum rotation without structural instability which could cause the drum to slip or vibrate. In particular, care should be taken to avoid resonant frequences at the operating speeds for the casting surface 14. The casting surface 14 should be capable of moving at a surface speed of from about 200 linear surface feet per minute to more that about 10,000 linear surface feet per minute, preferably 1800 to about 4000 linear surface feet per minute. When utilizing a drum having a circumference of about 8 feet, this rate calculates to a drum speed from about 25 rpm to about 1250 rpm. A three horsepower variable speed reversible, dynamically braked motor provides an adequate drive system for an integral copper alloy casting drum approximately 2 inches thick and about 8 feet in circumference.

In one embodiment, the casting surface 14 on the wheel or drum of the apparatus of the present invention is smooth. It has been found that in certain applications, such as for producing amorphous materials, finishing the peripheral surface 14 of a casting drum 12 with 400-grit paper and preferably with 600-grit paper may yield improved product uniformity.

In a preferred embodiment as illustrated in FIG. 2, the nozzle 24 is defined by an insert made of clay graphite, a molten metal resistant material, held in the walls of the crucible 22. The slot 30 is cut ultrasonically in the clay graphite nozzle 24. The first lip 32 and the second lip 34 of the nozzle 24 define the slot 30 therebetween. As alternative preferred examples of nozzle 24 materials, a plate made of quartz or vycor material or an insert of boron nitride may be employed. The desired slot forming the orifice, may be accurately cut therein with an ultrasonic drill. A preferred one piece element forming a nozzle, as best illustrated in FIG. 2, may be constructed of a semi-circular ring of molten metal resistant material. In this example, a slot having a width of about 0.010 to about 0.080 inch between the facing, parallel inside surfaces 36 and 38 may be ultrasonically drilled into a clay graphite insert material, and the insert is held in the crucible 22. It should be understood that the design of the insert may be modified to assist in holding the insert forming the nozzle 24 in the crucible 22.

A preferred nozzle 24 of the apparatus of the present invention is shown in enlarged cross-section in FIG. 2. In one embodiment of this apparatus, the dimensions indicated in FIG. 2 have the following preferred limitations.

| dimension | designation | preferred limitation | more preferred limitation |
|---|---|---|---|
| a | bottom surface of first lip | at least .001 inch | .25–.50 inch |
| b | width of slot at maximum divergence | .020–.200 inch | 0.125 inch |
| c | bottom surface of second lip | .01–.16 inch | .02–.06 inch |
| d | standoff distance between second lip and casting surface | less than .080 inch | less than .010 inch |
| e | standoff distance between first lip and casting surface | less than .080 inch | less than .010 inch |
| f | width of slot between parallel, facing surfaces | .010–.080 inch | .025–.035 inch |
| g | depth of diverging area of slot | .050–.200 inch | .125 inch |
| h | depth of parallel area of slot | .050–.200 inch | .125 inch |

In the production of amorphous strip materials the width of the slot f is typically in the range of from about 0.010 to 0.040 inch. In the production of crystalline strip material, such as stainless steel, the width of the slot f may be greater, perhaps as high as about 0.080 inch if thick strip is being uniformly produced in accordance with the present invention. Also, the primary purpose of a relief at an inner portion of the slot 30, such as is shown in FIGS. 3 and 5 is to eliminate clogging of molten metal in the orifice during strip casting. Preferably, bottom surface 44 of first lip 32 has a length at least twice the width f of slot 30 between parallel facing surfaces 36 and 38.

In an exemplary operation of the apparatus of the present invention, molten metal is delivered to a heated crucible 22. It is understood that a heater, such as induction coils of resistance wire, may be provided in and above the crucible 22 to maintain relatively constant molten metal temperatures as may be desired. Alternatively, the molten metal may be poured directly into a preheated crucible. The preheat temperature should prevent freezing or clogging of the slot 30 during the initial casting operation, and the temperature of the flowing metal should thereafter keep the crucible 22 and nozzle 24 at sufficient temperature to insure uninterrupted molten metal flow through the orifice. In certain applications, the nozzle itself may be externally heated throughout the casting operation. Also, the metal which is fed to the crucible 22 may be superheated to allow a certain degree of temperature loss without adversely affecting metal flow through the nozzle 24.

Also, a metallostatic head height in the tundish 22 is preferably maintained at a relatively constant level, typically at a level of less than ten inches above the nozzle 24, throughout the casting operation to assure that a relatively constant static head pressure may be maintained at the nozzle 24. This may be accomplished by initially pouring the molten metal into the crucible to the desired height and thereafter controlling the rate at which additional molten metal is poured into the crucible to maintain the metallostatic head. It is understandable that the rate at which additional molten metal is fed to the crucible 22 should be in substantial conformity with the rate at which metal flows from the nozzle orifice onto the casting surface 14 in forming strip material. Maintenance of a relatively constant height of metal in the crucible assures that the molten metal flow pressure through the orifice is maintained relatively constant so as not to adversely affect the casting operation or the quality of the strip material. Alternatively, externally applied pressure may be employed to control the pressure at the nozzle.

The nozzle 24 of the present invention is characterized by an outwardly diverging lip surfaces 40 and 42 at the outer portion of the slot 30. Such structure facilitates increased molten metal flow to a moving casting surface 14, resulting in improved lateral flow of molten metal onto a casting surface 14, and in the formation of high quality strip material 10. Preferably, width b of slot 30 at the outer portion is at least 0.01 inch greater than width f measured between facing parallel inside surfaces 36 and 38 of first lip 32 and second lip 34 respectively. More preferably, width b may range from 0.04 to about 0.18 inch, or 0.10 to about 0.15 inch. In a preferred embodiment the width b of the orifice of the slot 30 at the outermost divergent portion may be as wide as about 0.200 inch, which may be in excess of about four times the width f of the slot 30 as measured between the inner, parallel facing surfaces of the slot 30. Such structure provides a relatively large casting cavity at the outer portion of the nozzle 24, fed by a relatively narrow internal orifice. Lateral movement of the molten metal inside such cavity during strip casting has been found to improve the uniformity with which metal is supplied to the casting surface 14, and thus improve the quality of the strip 10 cast thereon. As discussed above, the presence of such cavity further reduces the tendency for nozzle blockage caused by freezing because the narrow metering orifice is located further from the cool casting surface 14.

Various alloys may be successfully cast using the apparatus of the present invention, including certain brazing alloys, including nickel based brazing alloys, stainless steel and certain silicon steel grades. In certain applications, the cast alloy has been shown to be amorphous, and in other applications, the cast strip material has been shown to be crystalline.

During casting of strip material, the tendency of the strip 10 to adhere to the casting surface 14 for a significant distance, such as several feet or more, beyond the nozzle has been observed. It is understandable that if the strip material remains on a rotating casting drum or wheel 12 for a full revolution damage to the crucible 22, particularly to the nozzle orifice could result. It has been found that the use of a doctor blade, such as a knife type element riding at or near the drum surface 14, or an air wiper, approximately 2.5 to 6 feet from the orifice, or more, easily counters such adherence. With such an arrangement, the cast strip may be removed from the drum by such doctor blade. Such doctor blade has been found particularly useful in the production of thinner amorphous strip materials which appear to have a greater tendency to adhere to the casting surface 14 than do the crystalline strip materials. It is believed that the force which retains the strip on the casting surface may reflect the quality of the thermal contact between the strip and the casting surface.

The casting of relatively high quality strip material including amorphous material, which for the purpose of this invention includes materials which are at least 25% amorphous, is feasible and practical using the apparatus and procedures described above. Understandably, the quench rates must be higher for amorphous material as compared to crystalline material. Quench rates may be accelerated such as by increasing the speed of the casting surface, or the like.

Whereas the preferred embodiment has been described above for the purposes of illustration, it will be apparent to those skilled in the art that numerous variations of the details may be made without departing from the invention.

I claim:

1. An apparatus for continuously casting metal strip comprising:

a tundish for receiving and holding molten metal, a nozzle comprising a slotted element disposed in the tundish with the longitudinal extend of the slot approximating the width of the strip to be cast, said slot having substantially uniform cross-sectional dimensions throughout the longitudinal extent thereof, a cooled casting surface at least as wide as the strip to be case, disposed outside the nozzle, moveable past the nozzle in a direction substantially perpendicular to the longitudinal axis of the slot, said slot defined between a first lip and a second lip of the nozzle, and having an inner portion near the tundish and an outer portion adjacent the casting surface, said first lip and said second lip having substantially planar inside surfaces, facing one another at the inner portion of the slot, said inside surfaces are parallel to one another at least at the inner portion of the slot and diverging from one another at the outer portion of the slot, the width of the outermost divergent portion being in excess of four times the width of said slot, as measured between inner parallel facing surfaces, and said first lip and said second lip having bottom surfaces facing the casting surface at a standoff distance less than about 0.120 inch, the bottom surface of said first lip having a length at least twice the width of said inner portion of said slot.

2. An apparatus as set forth in claim 1 wherein the gap between the facing parallel inside surfaces of the first and second lips is from about 0.010 to about 0.040 inch.

3. An apparatus as set forth in claim 1 wherein the gap between the inside surfaces of the first and second lips at the outer portion of the slot is at least 0.010 inch greater than the gap between the facing parallel inside surfaces of the first and second lips.

4. An apparatus as set forth in claim 1 wherein the gap between the inside surfaces of the first and second lips at the outer diverging portion of the slot is from about 0.04 to about 0.18 inch.

5. An apparatus as set forth in claim 1 wherein the gap between the inside surfaces of the first and second lips at the outer diverging portion of the slot is from about 0.10 to about 0.15 inch.

6. An apparatus as set forth in claim 1 wherein the casting surface is movable past the nozzle at a rate of from about 200 to about 10,000 linear surface feet per minute.

7. An apparatus as set forth in claim 1 wherein the casting surface is movable past the nozzle at a rate of from about 1,800 to about 4,000 linear surface feet per minute.

8. An apparatus as set forth in claim 1 wherein the casting surface comprises the peripheral surface of a water cooled wheel.

9. An apparatus as set forth in claim 8 wherein the wheel is made of a metal selected from the group consisting of copper, copper alloy, aluminum, aluminum alloy, steel, molybdenum and combinations thereof.

10. An apparatus as set forth in claim 1 wherein the nozzle is constructed of a material selected from the group consisting of graphite, alumina graphite, clay graphite, quartz, fiberized kaolin, boron nitride, silicon nitride, silicon carbide, boron carbide, alumina, zirconia, stabilized zirconia silicate, magnesia and combinations thereof.

11. An apparatus as set forth in claim 1 wherein at least a portion of the bottom surfaces of the first and second lip are in complete parallelism with casting surfaces therebelow.

* * * * *